US011266282B2

(12) United States Patent
Tsuchida et al.

(10) Patent No.: US 11,266,282 B2
(45) Date of Patent: Mar. 8, 2022

(54) SUCTION TOOL AND ELECTRIC VACUUM CLEANER

(71) Applicant: Mitsubishi Electric Corporation, Tokyo (JP)

(72) Inventors: Kazuchika Tsuchida, Tokyo (JP); Katsuyuki Yamamoto, Tokyo (JP); Emi Tsukamoto, Tokyo (JP); Masami Kurosaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 220 days.

(21) Appl. No.: 16/322,144

(22) PCT Filed: Oct. 25, 2016

(86) PCT No.: PCT/JP2016/081616
§ 371 (c)(1),
(2) Date: Jan. 31, 2019

(87) PCT Pub. No.: WO2018/078725
PCT Pub. Date: May 3, 2018

(65) Prior Publication Data

US 2019/0239705 A1 Aug. 8, 2019

(51) Int. Cl.
*A47L 9/02* (2006.01)

(52) U.S. Cl.
CPC ..... *A47L 9/02* (2013.01)

(58) Field of Classification Search
CPC ... A47L 9/02; A47L 9/24; A47L 9/242; A47L 9/248; A47L 9/244; A47L 9/0027;
(Continued)

(56) References Cited

U.S. PATENT DOCUMENTS 1,860,854 A * 5/1932 Engberg ..... A47L 9/02 15/416
3,238,557 A * 3/1966 Foster ..... A47L 9/02 15/339

(Continued)

FOREIGN PATENT DOCUMENTS

CH 700748 A2 * 10/2010 ..... A47L 9/248
CN 1827026 A 9/2006

(Continued)

OTHER PUBLICATIONS

International Search Report of the International Searching Authority dated Dec. 20, 2016 for the corresponding International application No. PCT/JP2016/081616 (and English translation).

(Continued)

*Primary Examiner* — Joseph J Hail
*Assistant Examiner* — Jonathan R Zaworski
(74) *Attorney, Agent, or Firm* — Posz Law Group, PLC

(57) ABSTRACT

A suction tool includes: a hollow cylindrical main pipe having: a rear end side connected to a vacuum cleaner main body; a front end portion in which a main suction port is formed; and a hollow cylindrical sub pipe having: a rear end side at which an inside of the hollow cylindrical sub pipe communicates with an inside of the main pipe; and a front end portion in which a sub suction port is formed. The sub pipe is movable between a retracted position in which the front end portion of the sub pipe is arranged so as to be retracted from the front end portion of the main pipe, and a use position in which the front end portion of the sub pipe is arranged so as to protrude from the front end portion of the main pipe along an axial direction of the main pipe.

6 Claims, 8 Drawing Sheets

(58) Field of Classification Search
CPC ..... A47L 9/04; A47L 9/0461; A47L 9/0488; A47L 9/068; A47L 5/362
USPC ..... 15/331, 328, 329, 334, 338, 414, 415.1, 15/4, 315
See application file for complete search history.

(56) References Cited

U.S. PATENT DOCUMENTS

| | | | | | |
|---|---|---|---|---|---|
| 4,723,338 | A * | 2/1988 | Otsubo | A47L 9/02 15/331 |
| 5,927,758 | A * | 7/1999 | Carlsson | A47L 9/244 285/7 |
| 7,437,797 | B2 * | 10/2008 | Ptak | A47L 7/0057 15/144.4 |

FOREIGN PATENT DOCUMENTS

| | | | | | |
|---|---|---|---|---|---|
| CN | 102048497 | A | * | 5/2011 | |
| EP | 0679363 | A2 | * | 11/1995 | A47L 9/02 |
| GB | 2308540 | A | * | 7/1997 | A47L 9/06 |
| GB | 2388526 | A | * | 11/2003 | A47L 9/0027 |
| GB | 2477302 | A | * | 8/2011 | A47L 9/0606 |
| JP | 02065825 | A | * | 3/1990 | |
| JP | H02-065825 | A | | 3/1990 | |
| JP | H04-28856 | U | | 3/1992 | |
| JP | H04-122329 | A | | 4/1992 | |
| JP | 3094772 | U | | 7/2003 | |
| JP | 3094772 | U | * | 7/2003 | |
| JP | 3123631 | U | | 7/2006 | |
| JP | 2007-260035 | A | | 10/2007 | |
| JP | 2007260035 | A | * | 10/2007 | |
| JP | 2010-136799 | A | | 6/2010 | |
| JP | 2010136799 | A | * | 6/2010 | |
| JP | 2015-150011 | A | | 8/2015 | |
| JP | 2015150011 | A | * | 8/2015 | |
| KR | 19980028322 | U | * | 8/1998 | |
| KR | 100870300 | B1 | * | 11/2008 | |
| KR | 20100006513 | U | * | 6/2010 | |
| KR | 20130110373 | A | * | 10/2013 | |
| KR | 20140037538 | A | * | 3/2014 | |
| WO | 2017/208290 | A1 | | 12/2017 | |
| WO | 2017/208291 | A1 | | 12/2017 | |
| WO | 2017/208293 | A1 | | 12/2017 | |

OTHER PUBLICATIONS

Office Action dated Feb. 18, 2020 issued in corresponding JP patent application No. 2018-546973 (and English translation).
Office Action dated Aug. 25, 2020 issued in corresponding CN patent application No. 201680089444.4 (and English translation).
Office Action dated May 26, 2020 issued in corresponding JP patent application No. 2018-546973 (and English translation).
Chinese Office Action dated Mar. 19, 2021, issued in corresponding Chinese Patent Application No. 201680089444.4 (and English Machine Translation).
Office Action dated Jun. 29, 2021, issued in corresponding CN Patent Application No. 201680089444.4 (and English Machine Translation).

* cited by examiner

SUCTION TOOL AND ELECTRIC VACUUM CLEANER

CROSS REFERENCE TO RELATED APPLICATION

This application is a U.S. national stage application of PCT/JP2016/081616 filed on Oct. 25, 2016, the contents of which are incorporated herein by reference.

FIELD

The present invention relates to a suction tool and an electric vacuum cleaner.

BACKGROUND

As a suction tool for an electric vacuum cleaner, an interspace nozzle for removing dust and the like piled up in a narrow interspace between a piece of furniture, the wall, and the floor is known. In addition, there is also known a suction tool including a coupling part connected to a hose unit of an electric vacuum cleaner in an attachable and detachable manner, and a hollow and flat suction part that is long in the axial direction of the hose unit and is integrally formed with the coupling part, in which a plurality of suction holes that communicate with a hollow part are formed in an upper surface and a lower surface of the suction part in the longitudinal direction at predetermined intervals, and a fabric is provided along the suction holes in the longitudinal direction (for example, see PTL 1).

CITATION LIST

Patent Literature

[PTL 1] JP 2010-136799 A

SUMMARY

Technical Problem

However, in the interspace nozzle and the suction tool as described in PTL 1, when a wide-width suction tool for floor cleaning and a suction tool for cleaning a narrow interspace are desired to be used properly, the necessary suction tool needs to be replaced or exchanged with respect to a pipe of the hose unit of the electric vacuum cleaner each time, and it is complicated.

The present invention has been made in order to solve the problem as above. An object thereof is to obtain a suction tool and an electric vacuum cleaner that enable the use of a suction tool for cleaning a narrow interspace without the replacement or exchange of a suction tool, and are capable of enhancing convenience.

Solution to Problem

A suction tool according to the present invention includes: a hollow cylindrical main pipe having: a rear end side connected to a vacuum cleaner main body; and a front end portion in which a main suction port is formed; and a hollow cylindrical sub pipe having: a rear end side at which an inside of the sub pipe communicates with an inside of the main pipe; and a front end portion in which a sub suction port is formed, the sub pipe being provided so as to be movable between a retracted position in which the front end portion of the sub pipe is arranged so as to be retracted from the front end portion of the main pipe, and a use position in which the front end portion of the sub pipe is arranged so as to protrude from the front end portion of the main pipe along an axial direction of the main pipe.

Or a suction tool according to the present invention includes: a hollow cylindrical main pipe having: a rear end side connected to a vacuum cleaner main body; and a front end portion in which a main suction port is formed; a suction port body attached to the front end portion of the main pipe in an attachable and detachable manner, the suction port body having a bottom surface in which a suction port is formed; and a hollow cylindrical sub pipe having a front end portion in which a sub suction port is formed, the sub pipe being provided so as to be movable between a retracted position in which the front end portion of the sub pipe is retracted from the front end portion of the suction port body and is housed in the suction port body, and a use position in which the front end portion of the sub pipe is arranged so as to protrude from the front end portion of the suction port body, an inside of the sub pipe communicating with an inside of the suction port body at a rear end side of the sub pipe when the sub pipe is in the use position.

And an electric vacuum cleaner according to the present invention includes: the suction tool configured as described above; and the vacuum cleaner main body.

Advantageous Effects of Invention

The suction tool and the electric vacuum cleaner according to the present invention have an effect in which the use of the suction tool for cleaning the narrow interspace is possible without the replacement or exchange of the suction tool, and the convenience can be enhanced.

DESCRIPTION OF EMBODIMENTS

Figure 1:
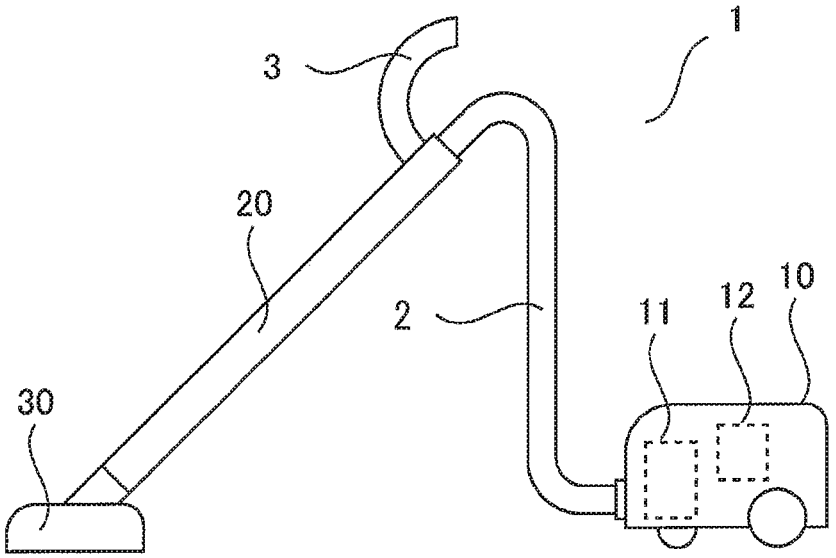
FIG. 1 is a view schematically illustrating the overall configuration of an electric vacuum cleaner including a suction tool according to a first embodiment of the present invention.

Embodiments of the present invention are described with reference to the accompanying drawings. Throughout the drawings, the same or corresponding parts are denoted by the same reference numerals and overlapping descriptions are simplified or omitted, as appropriate. Note that the present invention is not limited to the following embodiments, and various modifications can be made within the gist of the present invention.

First Embodiment

Figure 2:
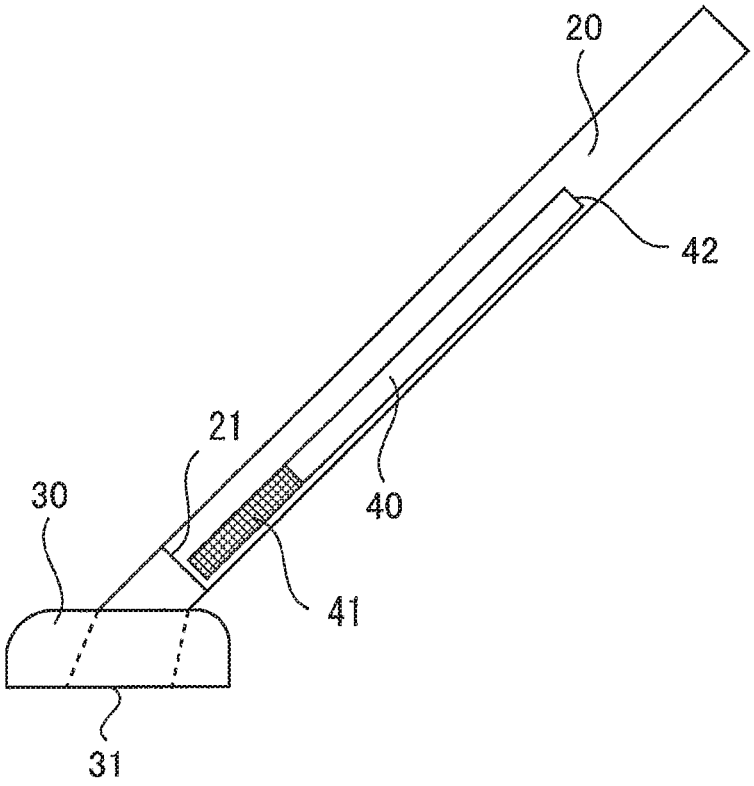
FIG. 2 is a view schematically illustrating the inside of a main pipe of the suction tool in perspective view according to the first embodiment of the present invention.
Figure 3:
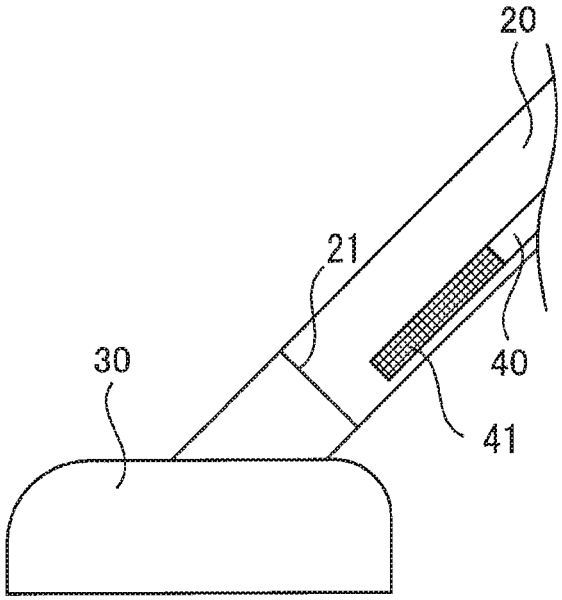
FIG. 3 is a view schematically illustrating a state in which a sub pipe of the suction tool is in a retracted position according to the first embodiment of the present invention.
Figure 4:
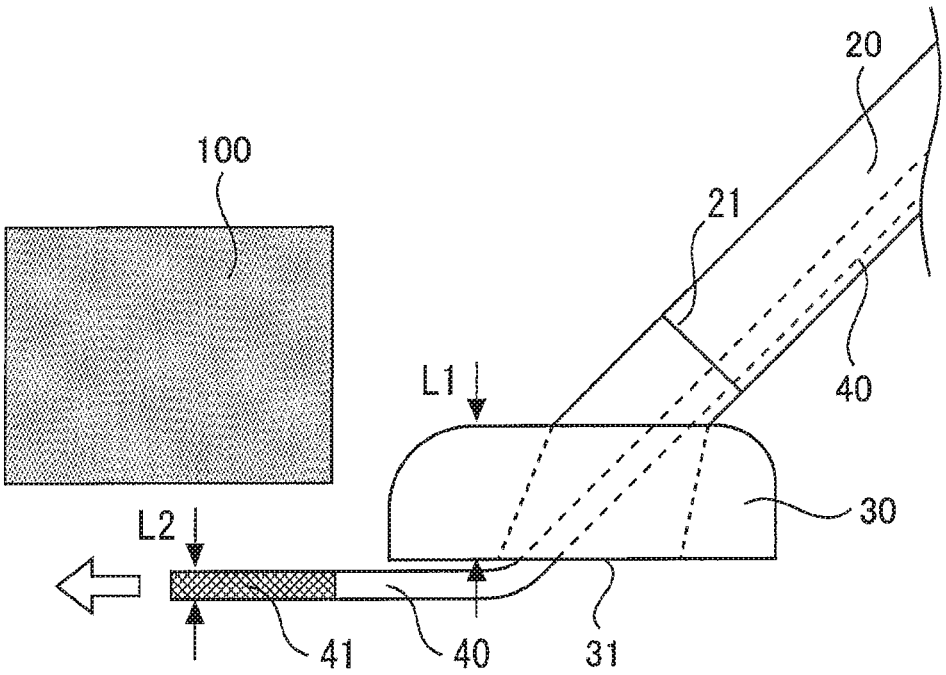
FIG. 4 is a view schematically illustrating an example of a state in which the sub pipe of the suction tool is in a use position according to the first embodiment of the present invention.
Figure 5:
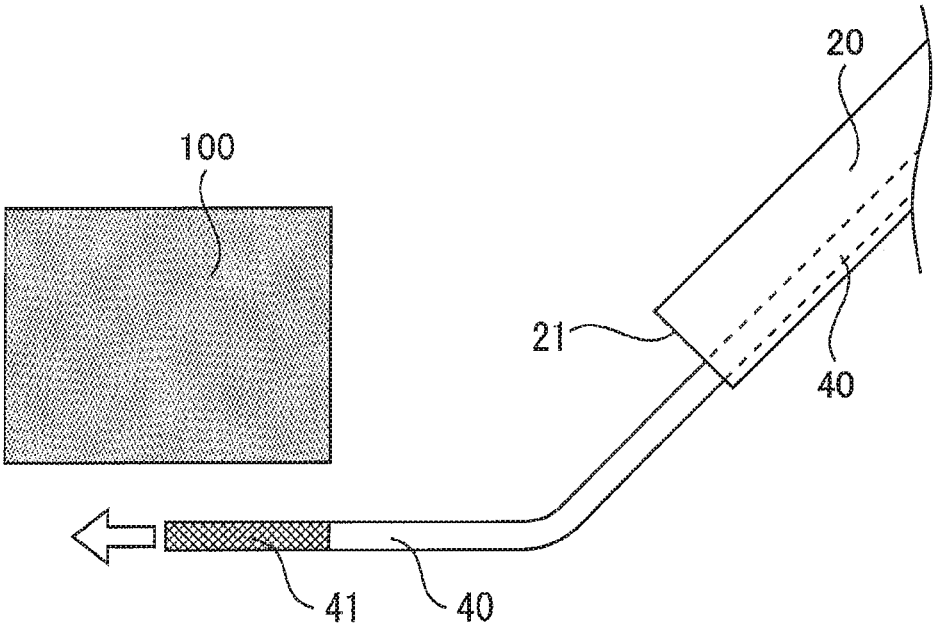
FIG. 5 is a view schematically illustrating another example of a state in which the sub pipe of the suction tool is in the use position according to the first embodiment of the present invention.
Figure 6:
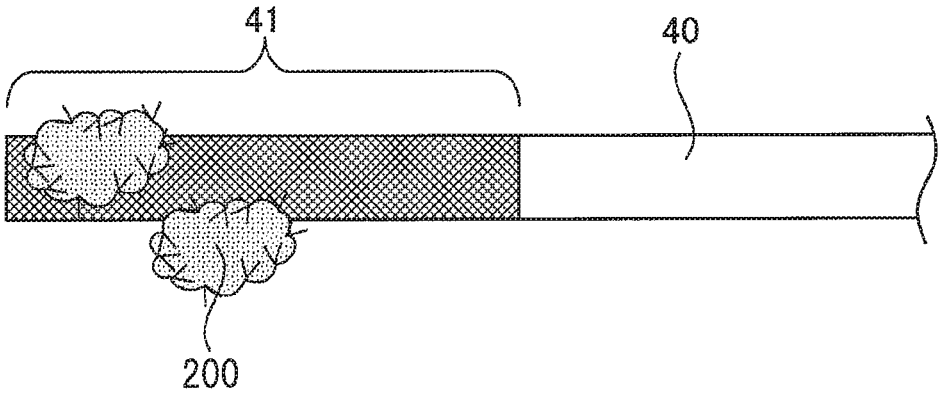
FIG. 6 is a view schematically illustrating a sub suction port of the sub pipe of the suction tool according to the first embodiment of the present invention.
Figure 7:
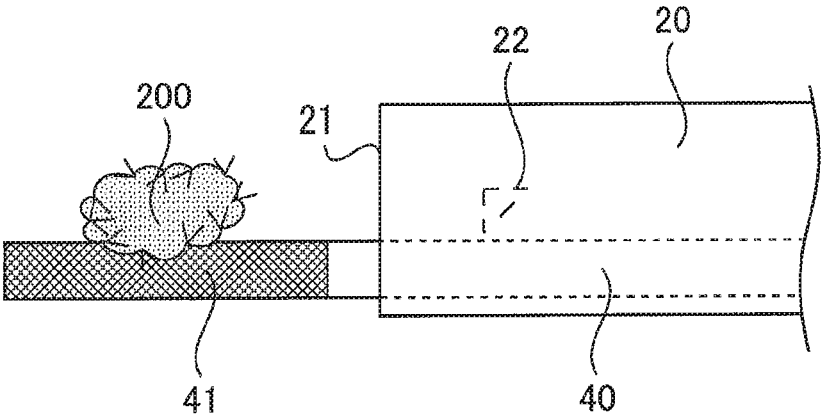
FIG. 7 is a view schematically illustrating the configuration of a trash removal portion provided in the main pipe of the suction tool according to the first embodiment of the present invention.
Figure 8:
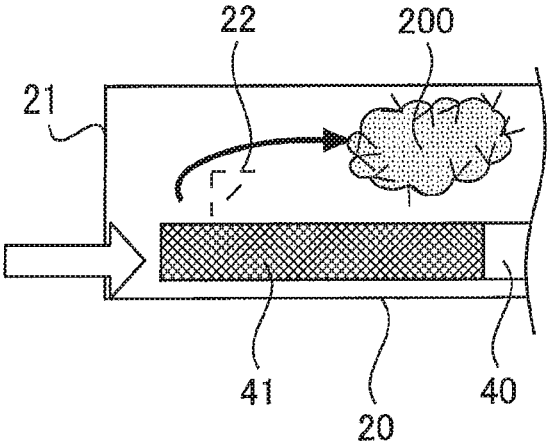
FIG. 8 is a view schematically illustrating the configuration of the trash removal portion provided in the main pipe of the suction tool according to the first embodiment of the present invention.

FIG. 1 to FIG. 8 are views according to a first embodiment of the present invention, in which FIG. 1 is a view schematically illustrating the overall configuration of an electric vacuum cleaner including a suction tool, FIG. 2 is a view schematically illustrating the inside of a main pipe of the suction tool in perspective view, FIG. 3 is a view schematically illustrating a state in which a sub pipe of the suction tool is in a retracted position, FIG. 4 is a view schematically illustrating an example of a state in which the sub pipe of the suction tool is in a use position, FIG. 5 is a view schematically illustrating another example of a state in which the sub pipe of the suction tool is in the use position, FIG. 6 is a view schematically illustrating a sub suction port of the sub pipe of the suction tool, FIG. 7 is a view schematically illustrating the configuration of a trash removal portion provided in the main pipe of the suction tool, and FIG. 8 is a view schematically illustrating the configuration of the trash removal portion provided in the main pipe of the suction tool.

As illustrated in FIG. 1, an electric vacuum cleaner 1 including the suction tool according to the first embodiment of the present invention includes a vacuum cleaner main body 10, a main pipe 20, and a suction port body 30. The vacuum cleaner main body 10 for separating trash from the air including trash (air containing dust), and emitting air (clear air) from which trash is removed (for example, returns the air into the room). A dust collecting portion 11 and an electric blower 12 are included in the vacuum cleaner main body 10. The dust collecting portion 11 is for capturing and collecting the trash (dust) in the air containing dust flowing into the vacuum cleaner main body 10. The electric blower 12 is for generating an air flow for sucking the air containing dust into the dust collecting portion 11 of the vacuum cleaner main body 10.

One end portion of a hose 2 is connected to a front end portion of the vacuum cleaner main body 10. The hose 2 is formed by a hollow cylindrical member having flexibility by bellows and the like. One end portion of the main pipe 20 is connected to the other end portion of the hose 2. The one end portion of the main pipe 20 connected to the hose 2 is referred to as a "rear end portion". In addition, the side of the one end portion of the main pipe 20 is referred to as a "rear end side" of the main pipe 20. As described above, the rear end side of the main pipe 20 is connected to the vacuum cleaner main body 10 via the hose 2.

The main pipe 20 is formed by a hollow cylindrical member. The main pipe 20 exhibits a linear hollow cylindrical shape here, for example. The suction port body 30 is connected to the other end portion of the main pipe 20 in an attachable and detachable manner. The other end portion of the main pipe 20 to which the suction port body 30 is connected is referred to as a "front end portion" of the main pipe 20. In addition, the side of the other end portion of the main pipe 20 is referred to as a "front end side" of the main pipe 20. The main pipe 20 is hollow as described above, and a main suction port 21 is formed in the front end portion of the main pipe 20. The main suction port 21 communicates with a space in the main pipe 20.

A handle 3 is attached to the main pipe 20. The handle 3 is for a user of the electric vacuum cleaner 1 to hold and operate. An operation switch (not shown) and the like for controlling the operation of the electric vacuum cleaner 1 is provided on the handle 3.

A suction port 31 is formed in the bottom surface of the suction port body 30. The suction port 31 is for sucking air (air containing dust) including trash, dust, and the like on a surface to be cleaned such as a floor surface. As described above, the suction port 31 of the suction port body 30 communicates with the dust collecting portion 11 of the vacuum cleaner main body 10 via the main pipe 20 and the hose 2. Further, the suction port body 30, the main pipe 20, and the hose 2 form a suction path for causing the air containing dust to flow into the vacuum cleaner main body 10 from the outside thereof.

As illustrated in FIG. 2, the suction tool according to the first embodiment of the present invention further includes a sub pipe 40 in addition to the main pipe 20 and the suction port body 30 described above. The sub pipe 40 is formed by a hollow cylindrical member. The sub pipe 40 exhibits a linear hollow cylindrical shape here, for example. The longitudinal direction, that is, the axial direction of the sub pipe 40 is arranged so as to be parallel with the longitudinal direction, that is, the axial direction of the main pipe 20.

The sub pipe 40 is provided between a preset retracted position and a preset use position so as to be movable along the axial direction of the main pipe 20. Specifically, for example, the sub pipe 40 can move along the axial direction of the main pipe 20 by being guided by a rail member (not shown) and the like provided along the axial direction of the main pipe 20. The movement of the sub pipe 40 between the retracted position and the use position can be performed by, for example, operating an operation lever (not shown) provided on the handle 3.

FIG. 3 illustrates a state in which the sub pipe 40 is in the retracted position. As illustrated in FIG. 3, in the first embodiment, the sub pipe 40 is arranged in the main pipe 20 in the retracted position. Here, an example in which the sub pipe 40 is arranged in a position close to a lower part in the main pipe 20 is illustrated. The outer diameter of the sub pipe 40 is smaller than the inner diameter of the main pipe 20. Specifically, for example, the inner diameter of the main pipe 20 is about 3 cm. Specifically, for example, the outer diameter of the sub pipe 40 is about 1 cm to 2 cm.

For both ends of the sub pipe 40 in the axial direction thereof, as with the case for the main pipe 20, the side close to the suction port body 30 is referred to as a "front end portion" and a "front end side" of the sub pipe 40. In addition, the side close to the hose 2, that is, the vacuum cleaner main body 10 is referred to as a "rear end portion" and a "rear end side" of the sub pipe 40. As illustrated in FIG. 3, when the sub pipe 40 is in the retracted position, the front end portion of the sub pipe 40 is arranged so as to be retracted from the front end portion of the main pipe 20.

FIG. 4 and FIG. 5 both illustrate a state in which the sub pipe 40 is in the use position. FIG. 4 is a state in which the suction port body 30 is attached to the front end portion of the main pipe 20. FIG. 5 is a state in which the suction port body 30 is removed from the front end portion of the main pipe 20. As illustrated in FIG. 4 and FIG. 5, when the sub pipe 40 is in the use position, the front end portion of the sub pipe 40 is arranged so as to protrude from the front end portion of the main pipe 20. In addition, as especially illustrated in FIG. 4, when the sub pipe 40 is in the use position in the state in which the suction port body 30 is attached to the front end portion of the main pipe 20, in the first embodiment, the sub pipe 40 protrudes from the suction port 31 of the suction port body 30.

At least a part of the sub pipe 40 has flexibility, that is, is formed by at least either of a structure or a material that can be freely bent. An example of a structure that can be freely bent includes bellows and the like similar to the hose 2 described above. In addition, an example of a material that can be freely bent includes soft vinyl resin, silicone resin, and the like.

At least a part of the sub pipe 40 can be freely bent, and hence, as illustrated in FIG. 4, the front end side of the sub pipe 40 in which the suction port 31 protrudes downward abuts against the surface to be cleaned such as the floor surface and bends. Therefore, the front end side of the sub pipe 40 protruding downward from the suction port 31 can be easily arranged on the front side of the suction port body 30 along the surface to be cleaned.

Here, an outer dimension L2 of the sub pipe 40 is smaller than a dimension L1 of the suction port body 30 in the height direction. Therefore, the front end portion of the sub pipe 40 can be inserted in an interspace between a piece of furniture 100 and the floor surface of which dimension in the height direction is smaller than L1 and into which the suction port body 30 cannot enter. Further, as described below, the floor surface under the piece of furniture 100 can be cleaned by causing dust and the like to be adsorbed on a sub suction port 41 on the front end portion of the sub pipe 40.

In addition, as illustrated in FIG. 5, also in a state in which the suction port body 30 is removed from the front end portion of the main pipe 20, the front end side of the sub pipe 40 protruding from the main suction port 21 of the main pipe 20 abuts against the surface to be cleaned such as the floor surface and bends. Further, the front end side of the sub pipe 40 protruding downward from the main suction port 21 can be easily arranged on the front side along the surface to be cleaned.

Here, as described above, the outer diameter of the sub pipe 40 is smaller than the inner diameter of the main pipe 20. Therefore, as a matter of course, the outer diameter of the sub pipe 40 is smaller than the outer diameter of the main pipe 20. Therefore, the front end portion of the sub pipe 40 can be inserted into the interspace between the piece of furniture 100 and the floor surface that is difficult for the front end portion of the main pipe 20 to enter. Further, as described below, the floor surface under the piece of furniture 100 can be cleaned by causing dust and the like to be adsorbed onto the sub suction port 41 on the front end portion of the sub pipe 40.

The sub suction port 41 is formed in the front end portion of the sub pipe 40. Here, for example, the sub suction port 41 is mesh-patterned. That is, the sub suction port 41 is formed as an aggregate in which a plurality of small holes are arranged in rows. The small holes forming the sub suction port 41 specifically each have an inner diameter of about 1 mm to 3 mm, for example. Note that the sub suction port 41 is not limited to be mesh-patterned. As another example, one hole having an inner diameter equal to the inner diameter of the sub pipe 40 may be provided as the sub suction port 41.

Description is continued by returning and referring to FIG. 2. The rear end side of the sub pipe 40 is open. Further, as illustrated in FIG. 2, a communicating portion 42 is formed on the rear end portion of the open sub pipe 40. Further, at the communicating portion 42, the inside of the sub pipe 40 and the inside of the main pipe 20 communicate with each other. That is, at the rear end side of the sub pipe 40, inside of the sub pipe 40 communicates with the inside of the main pipe 20. As described above, the sub suction port 41 on the front end portion of the sub pipe 40 communicates with an inside space of the main pipe 20 via an inside space of the sub pipe 40 and the communicating portion 42 formed on the rear end portion of the sub pipe 40.

When the suction tool formed as above is connected to the vacuum cleaner main body 10 and the electric blower 12 is driven, the negative pressure generated by the electric blower 12 is transmitted from the hose 2 into the main pipe 20. Further, by the negative pressure transmitted into the main pipe 20, suction power that sucks air into the main pipe 20 from the main suction port 21 of the main pipe 20 is generated.

In addition, as described above, at the communicating portion 42 on the rear end side of the sub pipe 40, the inside of the sub pipe 40 and the inside of the main pipe 20 communicate with each other. Therefore, the negative pressure in the main pipe 20 is also transmitted into the sub pipe 40 from the communicating portion 42. Further, by the negative pressure transmitted into the sub pipe 40, suction power that sucks air from the sub suction port 41 of the sub pipe 40 into the sub pipe 40 is generated. Therefore, by arranging the sub pipe 40 in the use position, trash, dust, and the like can be sucked into the sub suction port 41 of the sub pipe 40 externally protruding from the main suction port 21 of the main pipe 20.

At this time, in the first embodiment, as described above, the sub suction port 41 has a mesh-patterned form in which small holes are aggregated. Therefore, as illustrated in FIG. 6, large and relatively light trash 200 such as cotton dust does not pass through the sub suction port 41 and is adsorbed onto the outer side of the sub suction port 41. The sub pipe 40 has a small diameter, and hence there is a fear of clogging when large trash enters the inside of the sub pipe 40.

By forming the sub suction port 41 to be mesh-patterned and causing the large trash 200 such as cotton dust to be adsorbed onto the outer side of the sub suction port 41, the trash 200 can be removed from the surface to be cleaned with use of the sub pipe 40 while preventing the clogging of the sub pipe 40. In addition, large trash does not enter the inside of the sub pipe 40, and hence the sub pipe 40 can be narrow and thin, and the sub pipe 40 can be inserted into a narrower interspace. The trash 200 adsorbed onto the outer side of the sub suction port 41 can be sucked into the vacuum cleaner main body 10 by the air flow in the main pipe 20 by moving the sub pipe 40 to the retracted position.

Here, as illustrated in FIG. 7 and FIG. 8, the trash removal portion 22 may be provided in the main pipe 20. The trash removal portion 22 is arranged so as to be spaced from the outer surface of the sub pipe 40 at a certain interval. When the sub pipe 40 is moved from the use position toward the retracted position in a state in which the trash 200 is adsorbed onto the outer side of the sub suction port 41, the trash 200 on the outer side of the sub suction port 41 abuts against the trash removal portion 22. When the sub pipe 40 is further moved toward the retracted position in a state in which the trash 200 is abutting against the trash removal portion 22, the trash 200 is peeled off from the outer side of the sub suction port 41, and is removed from the sub pipe 40.

Note that the trash removal portion 22 may be arranged so as to be spaced from the outer surface of the sub pipe 40 at a certain interval as described above or may be provided so as to be able to come into contact with the outer surface of the sub pipe 40 with use of a soft material such as a brush, for example.

As described above, the trash removal portion 22 forms removing means for removing the trash 200 adsorbed on the outer side of the sub suction port 41 of the sub pipe 40 from the sub pipe 40 when the sub pipe 40 moves from the use position toward the retracted position. By including the trash removal portion 22 serving as the removing means as above, the trash 200 adsorbed on the sub pipe 40 can be securely removed from the sub pipe 40 and can be sucked from the main pipe 20 to the dust collecting portion 11 of the vacuum cleaner main body 10.

Note that, as illustrated in FIG. 3, FIG. 4, and FIG. 5, the main suction port 21 of the main pipe 20 is not occluded for both of the case in which the sub pipe 40 is in the retracted position and the case in which the sub pipe 40 is in the use position. That is, when the sub pipe 40 is in the retracted position, the front end portion of the sub pipe 40 is retracted from the front end portion of the main pipe 20, and hence the main suction port 21 is open. In addition, when the sub pipe 40 is in the use position, an interspace is sufficiently formed between the inner edge of the main suction port 21 and the outer edge of the sub pipe 40.

Further, when the sub pipe 40 is in the retracted position, the front end portion of the sub pipe 40 does not protrude from the main suction port 21, and hence the sub pipe 40 does not get in the way, and the main suction port 21 of the main pipe 20 can perform sucking.

In addition, the main suction port 21 is not occluded also when the sub pipe 40 is in the use position. Therefore, for example, as illustrated in FIG. 4, by connecting the suction port body 30 to the main suction port 21, the sucking at the suction port 31 of the suction port body 30 and the sucking at the sub suction port 41 of the sub pipe 40 can be simultaneously performed.

In the suction tool and the electric vacuum cleaner formed as above, the sub pipe 40 is provided so as to be movable between the retracted position in which the front end portion of the sub pipe 40 is arranged so as to be retracted from the front end portion of the main pipe 20, and the use position in which the front end portion of the sub pipe 40 is arranged so as to protrude from the front end portion of the main pipe 20 along the axial direction of the main pipe 20. Therefore, the sub pipe 40 can be used as the suction tool for cleaning the narrow interspace without replacing or exchanging the suction tool, and the convenience can be enhanced.

Second Embodiment

Figure 9:
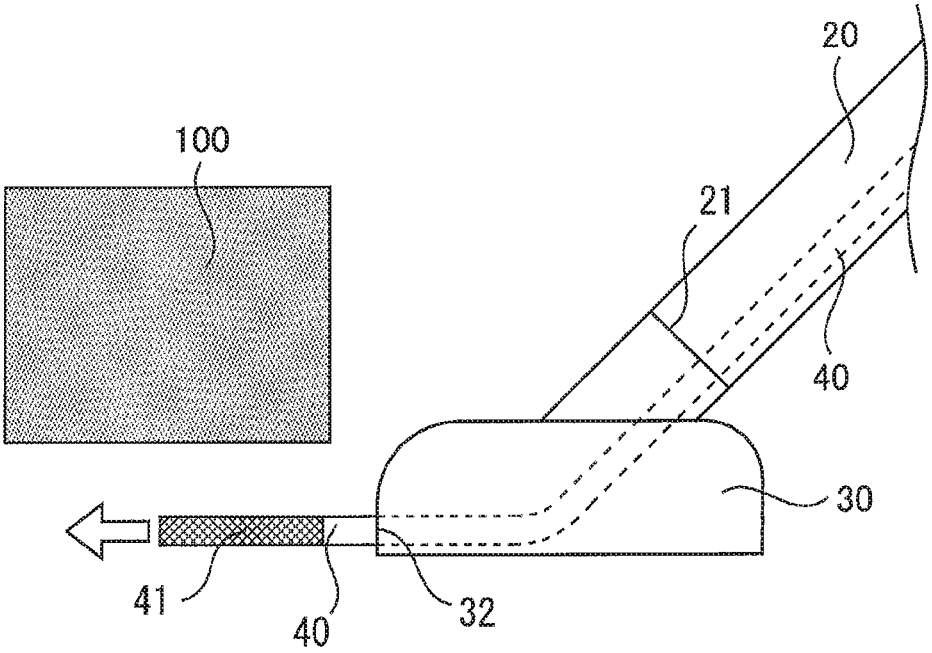
FIG. 9 is a view schematically illustrating an example of a state in which the sub pipe of the suction tool is in the use position according to a second embodiment of the present invention.

FIG. 9 is a view schematically illustrating an example of a state in which the sub pipe of the suction tool is in the use position according to a second embodiment of the present invention.

In the second embodiment described here, the configuration of the first embodiment described above is formed so that, when the sub pipe is arranged in the use position, the sub pipe protrudes forward from the front end portion of the suction port body and not from the suction port of the suction port body. For the suction tool and the electric vacuum cleaner according to the second embodiment, differences from the first embodiment are mainly described below.

As illustrated in FIG. 9, in the suction tool according to the second embodiment of the present invention, a sub pipe protrusion hole 32 is formed in the front portion of the suction port body 30. The sub pipe protrusion hole 32 passes through an inside space in the suction port body 30 that leads to the suction port 31 from a part of the suction port body 30 that is connected to the main pipe 20, and the front end portion of the suction port body 30.

When the sub pipe 40 is moved from the retracted position toward the use position, the front end portion of the sub pipe 40 enters the inside of the suction port body 30 from the inside of the main pipe 20 through the main suction port 21. When the suction port body 30 is placed on the surface to be cleaned so that the bottom surface of the suction port body 30 is opposed to the surface to be cleaned, the front end portion of the sub pipe 40 that has entered the inside of the suction port body 30 abuts against the surface to be cleaned at the suction port 31.

In this state, when the sub pipe 40 is further moved toward the use position, the front end portion of the sub pipe 40 in abutment against the surface to be cleaned bends forward. The front end portion of the sub pipe 40 facing forward enters the sub pipe protrusion hole 32. Further, the front end portion of the sub pipe 40 is exposed to the outside of the suction port body 30 from the sub pipe protrusion hole 32, and protrudes forward from the front end of the suction port body 30. As described above, the sub pipe 40 protrudes forward from the front end of the suction port body 30 in the use position.

Note that the sub pipe protrusion hole 32 is preferred to be occluded when the sub pipe 40 is not protruding from the front end of the suction port body 30. Specifically, for example, a cover, a valve, or the like having a structure that opens by being pushed from the inside of the sub pipe protrusion hole 32 is conceived to be provided.

Other configurations are similar to those in the first embodiment, and description thereof is omitted here.

In the suction tool and the electric vacuum cleaner formed as above, when the sub pipe 40 is arranged in the use position, the sub pipe 40 is not arranged below the bottom surface of the suction port body 30, and the lower edge of the sub pipe 40 and the bottom surface of the suction port body 30 are arranged in positions at heights that are almost the same.

Therefore, in addition to effects similar to those of the first embodiment being able to be exhibited, when the sub pipe 40 is arranged in the use position and sucking is performed with use of the sub suction port 41, the suction port body 30 can be entirely placed on the surface to be cleaned, and hence sucking using the sub suction port 41 of the sub pipe 40 can be performed in a steadier state.

In addition, also when the sub pipe 40 is arranged in the use position, the suction port 31 of the suction port body 30 can be used in a state of being closer to the surface to be cleaned, and hence sucking simultaneously using both of the suction port 31 of the suction port body 30 and the sub suction port 41 of the sub pipe 40 can be performed in an easier manner.

Third Embodiment

Figure 10:
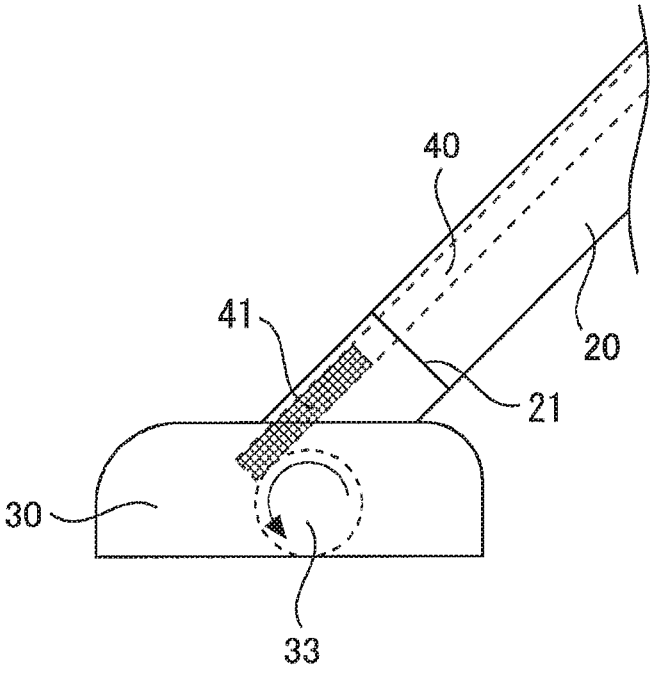
FIG. 10 is a view schematically illustrating a state in which the sub pipe of the suction tool is in the middle of moving from the retracted position toward the use position according to a third embodiment of the present invention.
Figure 11:
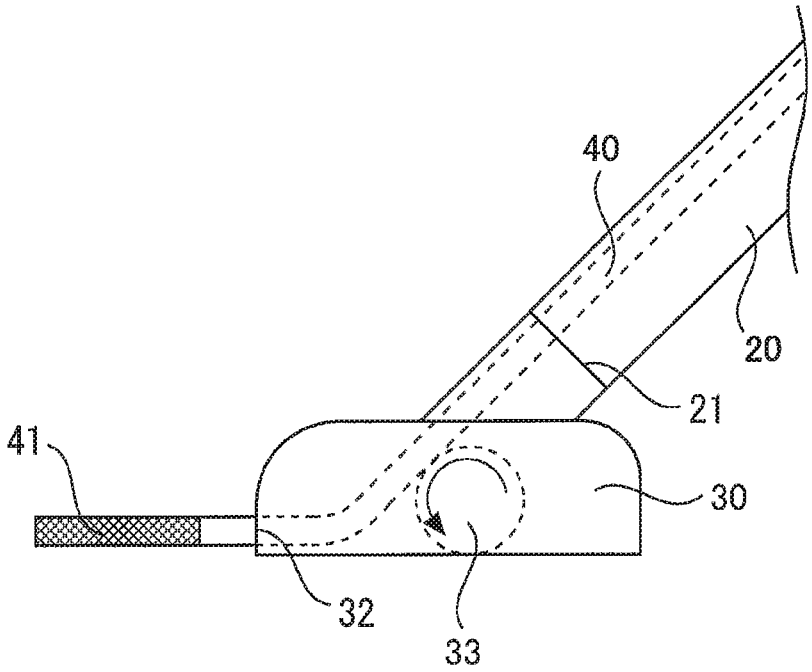
FIG. 11 is a view schematically illustrating a state in which the sub pipe of the suction tool is in the use position according to the third embodiment of the present invention.

FIG. 10 and FIG. 11 are views according to a third embodiment of the present invention, in which FIG. 10 is a view schematically illustrating a state in which the sub pipe of the suction tool is in the middle of moving from the retracted position toward the use position, and FIG. 11 is a view schematically illustrating a state in which the sub pipe of the suction tool is in the use position.

In the third embodiment described here, the configuration of the first embodiment or the second embodiment described above is formed so that the sub pipe in the use position is arranged on the upper side of a rotating brush of the suction port body so as to be able to come into contact with the rotating brush. For the suction tool and the electric vacuum cleaner according to the third embodiment, differences from the second embodiment are mainly described below by using an example based on the configuration of the second embodiment.

In the suction tool according to the third embodiment of the present invention, as illustrated in FIG. 10 and FIG. 11, the rotating brush 33 is provided in the suction port body 30. The rotating brush 33 is for scraping dust on the surface to be cleaned. The rotating brush 33 is arranged in the suction port body 30 so as to face the suction port 31. The rotation of the rotating brush 33 is driven by a motor (not shown) housed in the suction port body 30, for example.

FIG. 10 illustrates a state in which the sub pipe 40 is in a position between the retracted position and the use position. In the third embodiment, the sub pipe 40 in the retracted position is arranged in a position in the main pipe 20 that is close to the upper side. When the sub pipe 40 is moved from the retracted position toward the use position, the front end portion of the sub pipe 40 enters the inside of the suction port body 30 from the inside of the main pipe 20 through the main suction port 21. Further, the front end portion of the sub pipe 40 that has entered the inside of the suction port body 30 passes through the upper side of the rotating brush 33 arranged in the suction port body 30 as illustrated in FIG. 10.

When the sub pipe 40 is further moved toward the use position from a state illustrated in FIG. 10, the front end portion of the sub pipe 40 bends forward, and protrudes forward from the sub pipe protrusion hole 32 to the front end of the suction port body 30. FIG. 11 illustrates a state in which the sub pipe 40 is in the use position. As illustrated in FIG. 11, when the sub pipe 40 is in the use position, the front end portion of the sub pipe 40 is arranged so as to protrude from the front end portion of the main pipe 20.

In addition, in the use position, the sub pipe 40 is arranged on the upper side of the rotating brush 33 of the suction port body 30 so as to be able to come into contact with the rotating brush 33. When the electric blower 12 of the vacuum cleaner main body 10 is driven, the rotating brush 33 of the suction port body 30 rotates in the direction of the arrow in FIG. 11. When the trash 200 is sucked by the sub suction port 41 of the sub pipe 40, as illustrated in FIG. 6 of the first embodiment, the trash 200 is adsorbed onto the outer side of the sub suction port 41.

When the sub pipe 40 is moved from the use position toward the retracted position in this state, when the sub suction port 41 passes through the upper side of the rotating brush 33 (FIG. 10), the trash 200 adsorbed on the outer side of the sub suction port 41 can be scraped by the rotating brush 33. At this time, by arranging the sub pipe 40 on the upper side of the rotating brush 33, the movement direction of the sub pipe 40 moving from the use position toward the retracted position, and the rotation direction of the rotating brush in contact with the sub pipe 40 can be opposite directions, and the trash 200 on the outer side of the sub suction port 41 can be efficiently scraped by the rotating brush 33.

Note that other configurations are similar to those in the second embodiment, and description thereof is omitted here.

In the suction tool and the electric vacuum cleaner formed as above, in addition to effects similar to those of the first embodiment or the second embodiment being able to be exhibited, the trash 200 adsorbed on the sub suction port 41 of the sub pipe 40 can be removed by the rotating brush 33 of the suction port body 30 without providing the trash removal portion 22 as described in the first embodiment.

Fourth Embodiment

Figure 12:
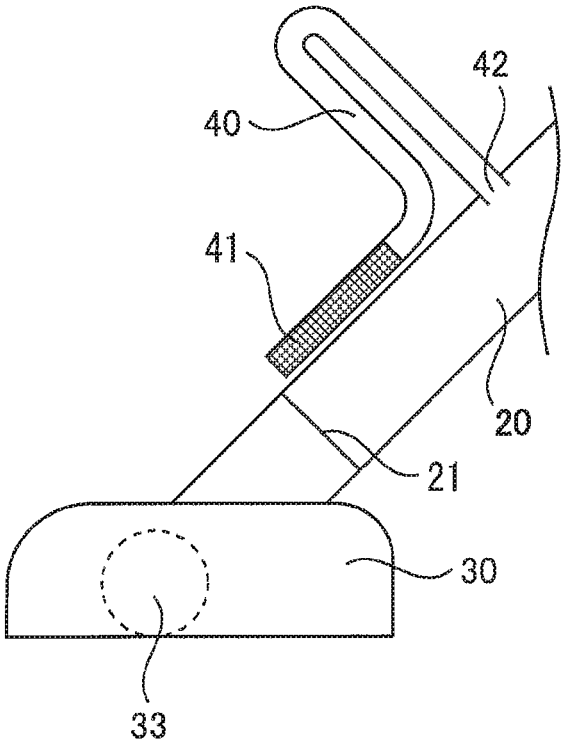
FIG. 12 a view schematically illustrating a state in which the sub pipe of the suction tool is in the retracted position according to a fourth embodiment of the present invention.
Figure 13:
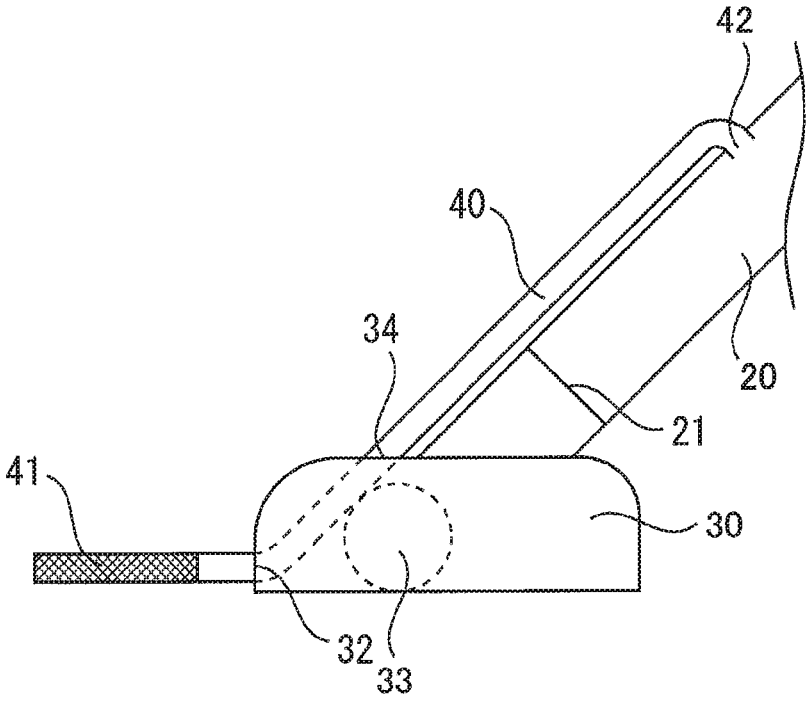
FIG. 13 is a view schematically illustrating a state in which the sub pipe of the suction tool is in the use position according to the fourth embodiment of the present invention.

FIG. 12 and FIG. 13 are views according to a fourth embodiment of the present invention, in which FIG. 12 a view schematically illustrating a state in which the sub pipe of the suction tool is in the retracted position, and FIG. 13 is a view schematically illustrating a state in which the sub pipe of the suction tool is in the use position.

In the fourth embodiment described here, any one of the configurations of the first embodiment to the third embodiment described above is formed so that the sub pipe is arranged on the outside of the main pipe 20. For the suction tool and the electric vacuum cleaner according to the fourth embodiment, differences from the third embodiment are mainly described below by using an example based on the configuration of the third embodiment.

As illustrated in FIG. 12 and FIG. 13, in the suction tool according to the fourth embodiment of the present invention, the sub pipe 40 is attached to the outer side of the main pipe 20. FIG. 12 illustrates a state in which the sub pipe 40 is in the retracted position. As illustrated in FIG. 12, in the fourth embodiment, the sub pipe 40 is arranged on the outside of the main pipe 20 in the retracted position. In addition, when the sub pipe 40 is in the retracted position, the front end portion of the sub pipe 40 is arranged so as to be retracted from the front end portion of the main pipe 20.

In the upper surface portion of the main pipe 20, an opening passing through the inside and the outside is formed. Further, the communicating portion 42 formed on the rear end portion of the sub pipe 40 is connected to the opening. In this manner, at the communicating portion 42, the inside of the sub pipe 40 and the inside of the main pipe 20 communicate with each other. That is, on the rear end side of the sub pipe 40, the inside of the sub pipe 40 communicates with the inside of the main pipe 20. In the example illustrated in FIG. 12, when the sub pipe 40 is in the retracted position, the part on the rear end side of the sub pipe 40 is folded.

FIG. 13 illustrates a state in which the sub pipe 40 is in the use position. As illustrated in FIG. 13, in the fourth embodiment, a sub pipe entering hole 34 is formed in the upper portion of the suction port body 30. The sub pipe entering hole 34 passes through the upper surface portion of the suction port body 30 and the inside space of the suction port body 30.

When the sub pipe 40 is moved from the retracted position toward the use position, the front end portion of the sub pipe 40 enters the inside of the suction port body 30 through the sub pipe entering hole 34. Further, the front end portion of the sub pipe 40 passes through the upper side of the rotating brush 33, bends forward in the suction port body 30, and protrudes forward from the sub pipe protrusion hole 32 to the front end of the suction port body 30.

Note that the sub pipe entering hole 34 is preferred to be occluded when the sub pipe 40 is not entering the inside of the suction port body 30 as with the sub pipe protrusion hole 32. Specifically, for example, a cover, a valve, or the like having a structure that opens by being pushed from the outer side of the sub pipe entering hole 34 is conceived to be provided.

In addition, instead of the sub pipe protrusion hole 32 and the sub pipe entering hole 34, a groove through which the sub pipe 40 passes may be formed in the suction port body 30.

Other configurations are similar to those in the third embodiment, and description thereof is omitted here.

Also in the suction tool and the electric vacuum cleaner formed as above, effects similar to those of any of the first embodiment to the third embodiment can be exhibited.

Fifth Embodiment

Figure 14:
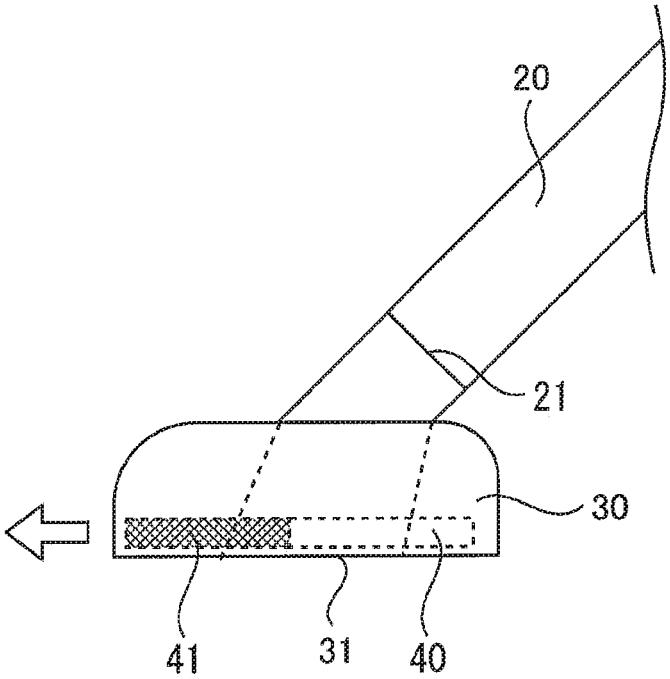
FIG. 14 is a view schematically illustrating a state in which the sub pipe of the suction tool is in the retracted position according to a fifth embodiment of the present invention.
Figure 15:
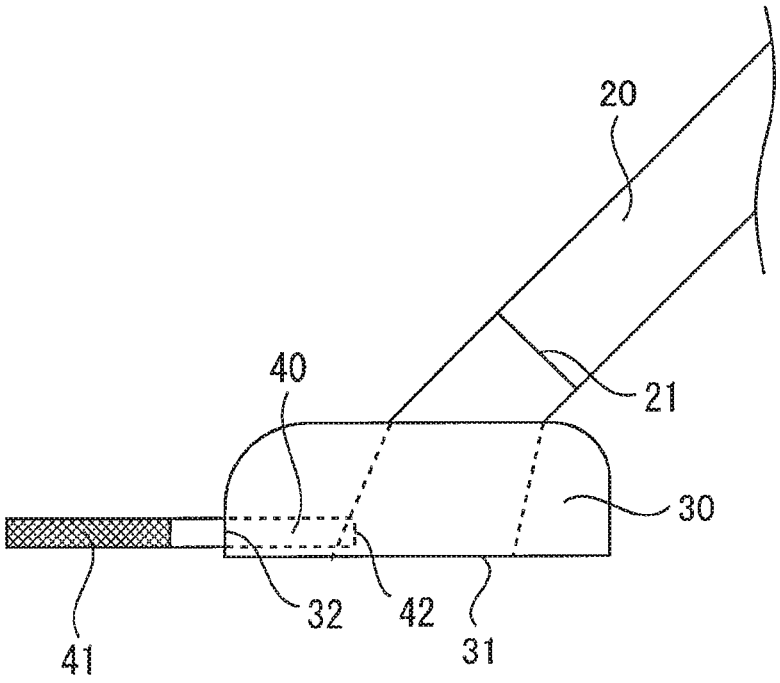
FIG. 15 is a view schematically illustrating a state in which the sub pipe of the suction tool is in the use position according to the fifth embodiment of the present invention.

FIG. 14 and FIG. 15 are views according to a fifth embodiment of the present invention, in which FIG. 14 is a view schematically illustrating a state in which the sub pipe of the suction tool is in the retracted position, and FIG. 15 is a view schematically illustrating a state in which the sub pipe of the suction tool is in the use position.

In the fifth embodiment described here, the configuration of the second embodiment described above is formed so that the sub pipe is housed in the suction port body when the sub pipe is not used. For the suction tool and the electric vacuum cleaner according to the fifth embodiment, differences from the second embodiment are mainly described below.

As illustrated in FIG. 14 and FIG. 15, in the suction tool according to the fifth embodiment of the present invention, the sub pipe 40 is provided in the suction port body 30 connected to the front end portion of the main pipe 20. The longitudinal direction, that is, the axial direction of the sub pipe 40 is arranged so as to be along the front-back direction and parallel with the bottom surface of the suction port body 30.

The sub pipe 40 is provided so as to be movable between a preset retracted position and a preset use position. Here, the sub pipe 40 is provided so as to be movable along the axial direction of the sub pipe 40, that is, along the front-back direction in parallel with the bottom surface of the suction port body 30. The movement of the sub pipe 40 between the retracted position and the use position can be performed by operating an operation lever (not shown) provided on the suction port body 30, for example.

FIG. 14 illustrates a state in which the sub pipe 40 is in the retracted position. As illustrated in FIG. 14, in the fifth embodiment, the sub pipe 40 is housed in the suction port body 30 in the retracted position. That is, when the sub pipe 40 is in the retracted position, the front end portion of the sub pipe 40 is arranged so as to be retracted from the front end portion of the suction port body 30.

FIG. 15 illustrates a state in which the sub pipe 40 is in the use position. As illustrated in FIG. 15, when the sub pipe 40 is in the use position, the front end portion of the sub pipe 40 is arranged so as to protrude from the front end portion of the main pipe 20. The rear end side of the sub pipe 40 is open, and has the communicating portion 42 formed thereon. Further, when the sub pipe 40 is in the use position, at the communicating portion 42, the inside of the sub pipe 40 and the inside of the suction port body 30 communicate with each other. That is, when the sub pipe 40 is in the use position, the inside of the sub pipe 40 communicates with the inside of the suction port body 30 at the rear end side of the sub pipe 40. As described above, when the sub pipe 40 is in the use position, the sub suction port 41 on the front end portion of the sub pipe 40 communicates with the inside space of the suction port body 30 via the inside space of the sub pipe 40 and the communicating portion 42 formed on the rear end portion of the sub pipe 40.

When the suction tool formed as above is connected to the vacuum cleaner main body 10 and the electric blower 12 is driven, the negative pressure generated by the electric blower 12 is transmitted into the main pipe 20 from the hose 2. The negative pressure transmitted into the main pipe 20 is transmitted into the suction port body 30 via the main suction port 21 of the main pipe 20. Further, the inside of the suction port body 30 becomes negative pressure, and hence a suction power that sucks air from the suction port 31 into the suction port body 30 is generated.

In addition, as described above, when the sub pipe 40 is in the use position, at the communicating portion 42 on the rear end side of the sub pipe 40, the inside of the sub pipe 40 and the inside of the suction port body 30 communicate with each other. Therefore, the negative pressure in the suction port body 30 is also transmitted into the sub pipe 40 from the communicating portion 42. Further, by the negative pressure transmitted into the sub pipe 40, the suction power that sucks air from the sub suction port 41 of the sub pipe 40 into the sub pipe 40 is generated. Therefore, by arranging the sub pipe 40 in the use position, trash, dust, and the like can be sucked to the sub suction port 41 of the sub pipe 40 protruding to a place in front of the suction port body 30.

Note that other configurations are similar to those in the second embodiment, and description thereof is omitted here.

In the suction tool and the electric vacuum cleaner formed as above, the sub pipe 40 is provided so as to be movable between the retracted position in which the front end portion of the sub pipe 40 retracts from the front end portion of the suction port body 30 and is housed in the suction port body 30, and the use position in which the front end portion of the sub pipe 40 is arranged so as to protrude from the front end portion of the suction port body 30. Further, when the sub pipe 40 is in the use position, the inside of the sub pipe 40 communicates with the inside of the suction port body 30 at the rear end side of the sub pipe 40. Therefore, as with the first embodiment and the like, without replacing or exchanging the suction tool, the sub pipe 40 can be used as the suction tool for cleaning the narrow interspace, and the convenience can be enhanced.

INDUSTRIAL APPLICABILITY

The present invention can be used for a suction tool including a hollow cylindrical main pipe having a rear end side connected to a vacuum cleaner main body and a front end portion in which a main suction port is formed, and an electric vacuum cleaner including the suction tool as above.

REFERENCE SIGNS LIST

1 Electric vacuum cleaner
2 Hose
3 Handle
10 Vacuum cleaner main body
11 Dust collecting portion
12 Electric blower
20 Main pipe
21 Main suction port
22 Trash removal portion
30 Suction port body
31 Suction port
32 Sub pipe protrusion hole
33 Rotating brush
34 Sub pipe entering hole
40 Sub pipe
41 Sub suction port
42 Communicating portion
100 Furniture
200 Trash

The invention claimed is:

1. A suction tool, comprising:

a hollow cylindrical main pipe having: a rear end side connected to a vacuum cleaner main body; and a front end portion in which a main suction port is formed; and a hollow cylindrical sub pipe having: a rear end side at which an inside of the sub pipe communicates with an inside of the main pipe; and a front end portion in which a sub suction port is formed, the sub pipe being provided so as to be movable between a retracted position in which the front end portion of the sub pipe is arranged so as to be retracted from the front end portion of the main pipe, and a use position in which the front end portion of the sub pipe is arranged so as to protrude from the front end portion of the main pipe along an axial direction of the main pipe, the sub pipe being arranged inside the main pipe in the retracted position, a part of the sub pipe being arranged so as to protrude from the main suction port outside the main pipe in the use position, the sub pipe being arranged so as to form an interspace between the inner edge of the main suction port and the outer edge of the sub pipe in the use position, the sub suction port provided in an outer side of the front end portion of the sub pipe along an axial direction of the sub pipe, the sub suction port being mesh-patterned, the suction tool further comprising a remover provided inside the main pipe, the remover configured to remove trash adsorbed on the outer side of the sub suction port of the sub pipe from the sub pipe when the sub pipe moves from the use position toward the retracted position, and the remover being spaced from an axial end of the main pipe.

2. The suction tool according to claim 1, wherein the main suction port of the main pipe is not occluded when the sub pipe is in either of the retracted position and the use position.

3. The suction tool, comprising:

a hollow cylindrical main pipe having: a rear end side connected to a vacuum cleaner main body; and a front end portion in which a main suction port is formed;

a hollow cylindrical sub pipe having: a rear end side at which an inside of the sub pipe communicates with an inside of the main pipe; and a front end portion in which a sub suction port is formed, a suction port body attached to the front end portion of the main pipe in an attachable and detachable manner, the suction port body having a bottom surface in which a suction port is formed, an outer dimension of the sub pipe being smaller than a dimension of the suction port body in a height direction, the suction port body including a rotating brush arranged in the suction port body so as to face the suction port, the sub pipe being provided so as to be movable between a retracted position in which the front end portion of the sub pipe is arranged so as to be retracted from the front end portion of the main pipe, and a use position in which the front end portion of the sub pipe is arranged so as to protrude from the front end portion of the main pipe along an axial direction of the main pipe, the sub pipe being arranged on an outside of the main pipe in the retracted position and being arranged on an upper side of the rotating brush of the suction port body so as to be able to come into contact with the rotating brush in the use position.

4. The suction tool according to claim 3, wherein the sub pipe is configured to protrude forward from the front end of the suction port body in the use position.

5. The suction tool according to claim 3, wherein the sub pipe is configured to protrude from the suction port of the suction port body in the use position.

6. An electric vacuum cleaner comprising:

a suction tool; and a vacuum cleaner main body, the suction tool including a hollow cylindrical main pipe having: a rear end side connected to the vacuum cleaner main body; and a front end portion in which a main suction port is formed; and a hollow cylindrical sub pipe having: a rear end side at which an inside of the sub pipe communicates with an inside of the main pipe; and a front end portion in which a sub suction port is formed, the sub pipe being provided so as to be movable between a retracted position in which the front end portion of the sub pipe is arranged so as to be retracted from the front end portion of the main pipe, and a use position in which the front end portion of the sub pipe is arranged so as to protrude from the front end portion of the main pipe along an axial direction of the main pipe, the sub pipe being arranged inside the main pipe in the retracted position, a part of the sub pipe being arranged so as to protrude from the main suction port outside the main pipe in the use position, the sub pipe being arranged so as to form an interspace between the inner edge of the main suction port and the outer edge of the sub pipe in the use position, the sub suction port provided in an outer side of the front end portion of the sub pipe along an axial direction of the sub pipe, the sub suction port being mesh-patterned, the suction tool further comprising a remover provided inside the main pipe, the remover configured to remove trash adsorbed on the outer side of the sub suction port of the sub pipe from the sub pipe when the sub pipe moves from the use position toward the retracted position, and the remover being spaced from an axial end of the main pipe.

* * * * *